US009033675B2

(12) United States Patent
Shimaguchi et al.

(10) Patent No.: US 9,033,675 B2
(45) Date of Patent: May 19, 2015

(54) ROTARY VANE COMPRESSOR

(75) Inventors: Hirotada Shimaguchi, Kuki (JP); Takashi Kubo, Saitama (JP); Junichirou Terazawa, Sano (JP)

(73) Assignee: CALSONIC KANSEI CORPORATION, Saitama-shi (JP)

( * ) Notice: Subject to any disclaimer, the term of this patent is extended or adjusted under 35 U.S.C. 154(b) by 294 days.

(21) Appl. No.: 13/505,864

(22) PCT Filed: Oct. 15, 2010

(86) PCT No.: PCT/JP2010/068146

§ 371 (c)(1),
(2), (4) Date: May 3, 2012

(87) PCT Pub. No.: WO2011/058848

PCT Pub. Date: May 19, 2011

(65) Prior Publication Data

US 2012/0224986 A1 Sep. 6, 2012

(30) Foreign Application Priority Data

Nov. 12, 2009 (JP) ..... 2009-258984

(51) Int. Cl.

| | |
|---|---|
| ***F04C 18/344*** | (2006.01) |
| ***F04C 28/06*** | (2006.01) |
| ***F04C 28/08*** | (2006.01) |
| *F04C 29/06* | (2006.01) |

(52) U.S. Cl.

CPC ..... *F04C 18/3446* (2013.01); *F04C 28/06* (2013.01); *F04C 28/08* (2013.01); *F04C 2270/701* (2013.01); *F04C 29/06* (2013.01)

(58) Field of Classification Search

CPC ..... F04C 18/3446; F04C 28/08; F04C 28/06; F04C 29/06; F04C 2270/701

See application file for complete search history.

(56) References Cited

U.S. PATENT DOCUMENTS

| | | | | |
|---|---|---|---|---|
| 3,421,413 | A * | 1/1969 | Adams et al. | 418/80 |
| 5,395,214 | A * | 3/1995 | Kawahara et al. | 417/53 |
| 6,354,821 | B1 * | 3/2002 | Hahn et al. | 418/55.1 |
| 6,913,451 | B2 * | 7/2005 | Hedrick et al. | 418/2 |
| 7,290,990 | B2 * | 11/2007 | Lifson | 417/53 |
| 2004/0156729 | A1 * | 8/2004 | Waterworth et al. | 417/236 |

FOREIGN PATENT DOCUMENTS

| | | | | |
|---|---|---|---|---|
| JP | 57-005592 | A * | 1/1982 | |
| JP | 57005592 | * | 12/1982 | F04C 29/10 |
| JP | 08-538 | Y2 | 1/1996 | |
| JP | 2002-285983 | A | 10/2002 | |
| JP | 2004-308482 | A | 11/2004 | |
| JP | 4234480 | B2 | 3/2009 | |

* cited by examiner

*Primary Examiner* — Bryan Lettman

(74) *Attorney, Agent, or Firm* — Foley & Lardner LLP

(57) ABSTRACT

A rotary vane compressor includes a cylinder chamber having an ellipsoidal inner wall shape, a rotor rotatably provided in the cylinder chamber, a vane held in the rotor so as to contact with an inner wall surface of the cylinder chamber along with a rotation of the rotor, a vane slot provided on the rotor and offset on a reverse rotational side of the rotor from a radial line passing over a rotational center of the rotor, and a controller for controlling a rotation of the rotor. The controller reversely rotates the rotor for a predetermined time upon activating the compressor. According to the compressor, chattering can be prevented by surely protruding the vane from the vane slot without providing extra parts. In addition, the vane can be produced with easy working processes at low cost.

5 Claims, 6 Drawing Sheets

ROTARY VANE COMPRESSOR

TECHNICAL FIELD

The present invention relates to a rotary vane compressor.

BACKGROUND ART

In a conventional rotary vane compressor, an intermediate pressure is introduced into backpressure spaces of vanes during operations, so that the vanes are protruded from vane slots. In addition, after stopped, since a pressure in the compressor becomes uniform, forces for protruding the vanes due to the intermediate pressure are not applied. Therefore, a vane whose end edge is directed upward becomes accommodated into a vane slot while lubrication oil in the vane slot is discharged through clearances due to its own weight. When the compressor is activated from the above state, centrifugal forces apply to the vanes so as to protrude them from the vane slots. Volume increase of the backpressure spaces is needed for a vane to protrude from a vane slot, but a lubrication oil amount introduced to the backpressure spaces through the clearances cannot follow and thereby the backpressure spaces have a negative pressure. As a result, the end edge of the vane protrudes insufficiently to contact with an inner wall of a cylinder chamber continuously, so that noises (chattering) may occur due to repeatedly contacting and separating between the inner wall of the cylinder chamber and the vanes.

In a Patent Document 1 listed below, disclosed is a compressor that has a mechanism for preventing chattering. The compressor includes a cylinder chamber with an ellipsoidal inner wall, a rotor rotatably provided in the cylinder chamber, and vanes held in the rotor so as to contact with the inner wall of the cylinder chamber along with a rotation of the rotor.

When the rotor rotates in the cylinder chamber, the vanes are protruded sufficiently from vane slots by biasing forces of coil springs in addition to a centrifugal force, so that end edges of the vanes surely contact with the inner wall of the cylinder chamber. As a result, refrigerant introduced into chambers surrounded by the inner wall of the cylinder chamber and the vanes can be surely compressed.

Namely, in the compressor, the chattering upon activating the compressor is prevented by providing the coil springs.

PRIOR ART DOCUMENT

Patent Document

Patent Document 1: Japanese Examined Utility Model Publication No. H8-538

SUMMARY OF INVENTION

However, in the compressor disclosed in the Patent Document 1, it is needed to provide the coil springs as extra parts. In addition, application of the coil springs increases assembling man-hours and thereby its costs. Further, working processes for the vanes become complicated due to the application of the coil springs.

Therefore, an object of the present invention is to provide a rotary vane compressor that prevents chattering without providing extra parts such as coil springs and whose vanes can be produced with easy working processes at low costs.

An aspect of the present invention provides a rotary vane compressor that includes a cylinder chamber having an ellipsoidal inner wall shape; a rotor rotatably provided in the cylinder chamber; a vane held in the rotor so as to contact with an inner wall surface of the cylinder chamber along with a rotation of the rotor; a vane slot provided on the rotor and offset on a reverse rotational side of the rotor from a radial line passing over a rotational center of the rotor; and a controller for controlling a rotation of the rotor, wherein the controller reversely rotates the rotor for a predetermined time upon activating the compressor.

According to the aspect, a force for protruding the vane from the vane slot applies effectively by reversely rotating the rotor upon activating the compressor. Therefore, a backpressure is generated in a backpressure space in the vane slot, so that refrigerant and lubrication oil is introduced into the backpressure space to protrude the vane from the vane slot smoothly. In this manner, since the vane is smoothly protruded from the vane slot, chattering can be prevented. In addition, extra working processes for the vane or the vane slot are not needed, so that the compressor can be produced at low cost.

Here, it is preferable that the controller reversely rotates the rotor at a slower speed than a normal rotational speed.

According to this, by reversely rotating the rotor at a lower speed than a normal rotational speed, secured can be a sufficient time for generating a backpressure in a backpressure space and introducing lubrication oil and refrigerant into the backpressure space through clearances.

In addition, it is preferable that the controller reversely rotates the rotor at 10 rpm or less.

If the reverse rotational speed is more than 10 rpm, the vane contacts with an inner wall surface near an ellipsoidal minor axis before protruding sufficiently from the vane slot. By the reverse rotational speed at 10 rpm or less, the vane can be protruded sufficiently.

DESCRIPTION OF EMBODIMENTS

Hereinafter, embodiments will be explained with reference to the drawings.

First Embodiment

Figure 1:
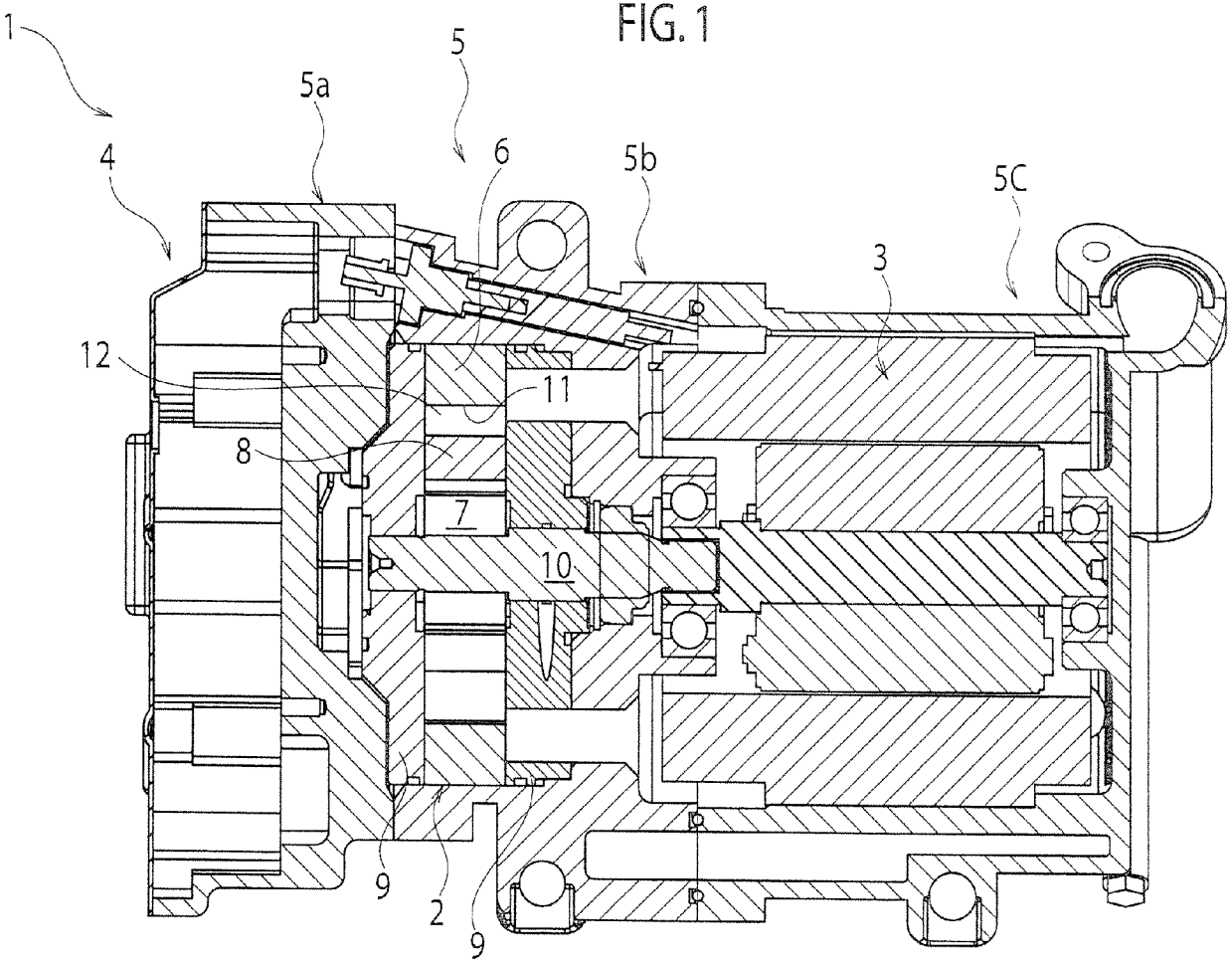
FIG. 1 is an overall vertical cross-sectional drawing of a compressor according to a first embodiment.
Figure 4:
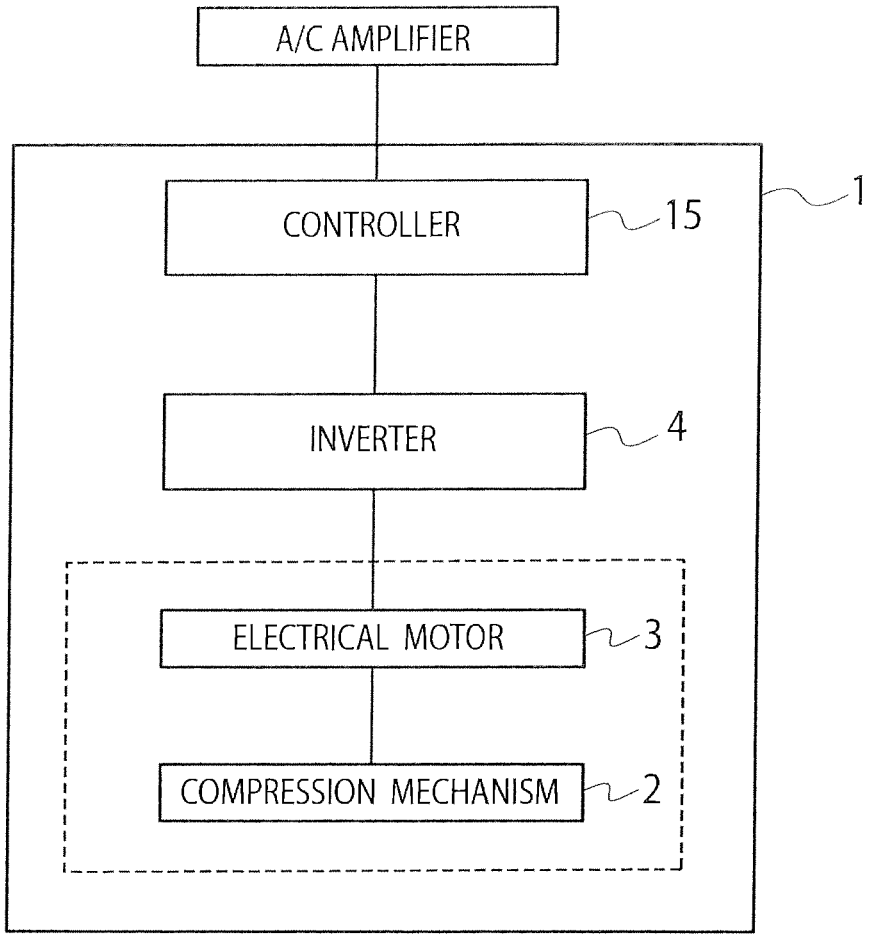
FIG. 4 is a block diagram of the compressor in the first embodiment.

As shown in FIGS. 1 and 4, a rotary vane compressor 1 according to the present embodiment includes, as its main components, a compression mechanism 2, electrical motor 3, an inverter 4, and a controller 15 for controlling the electrical motor 3 via the inverter 4. A housing 5 of the compressor 1 is comprised of a front housing 5*a*, a middle housing 5*b* and a rear housing 5*c*. An internal space sealed in the inside of the housing 5 by coupling these housings 5*a* to 5*c* with each other, and the compression mechanism 2 and the electrical motor 3 are housed in the internal space. The internal space is segmented by the compression mechanism 2, so that a suction chamber for refrigerant is provided on one side of the compression mechanism 2 (on a left side in FIG. 1) and a discharge chamber for refrigerant is provided on another side (on a right side in FIG. 1). The electrical motor 3 is provided in the discharge chamber for refrigerant.

Figure 2:
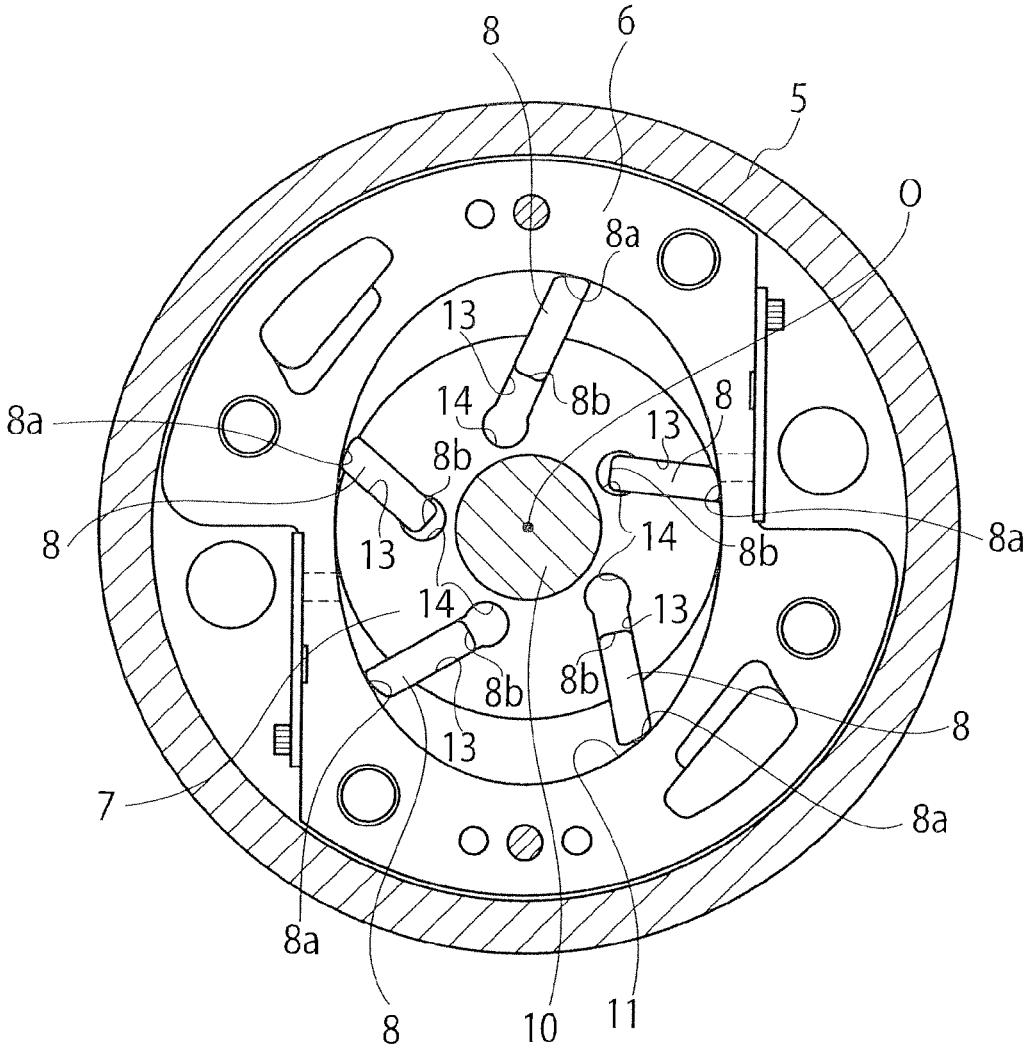
FIG. 2 is a cross-sectional drawing of a compression mechanism in the compressor.

As shown in FIG. 2, the compression mechanism 2 is a concentric rotor type compression unit, and includes, as its main components, a cylinder block 6, a rotor 7, vanes 8, a pair of side blocks 9, and a drive shaft 10. The cylinder block 6 includes a cylinder chamber 12 that has an ellipsoidal-shaped smooth inner wall surface 11. The rotor 7 is rotatably provided at a center of the cylinder chamber 12.

Figure 3:
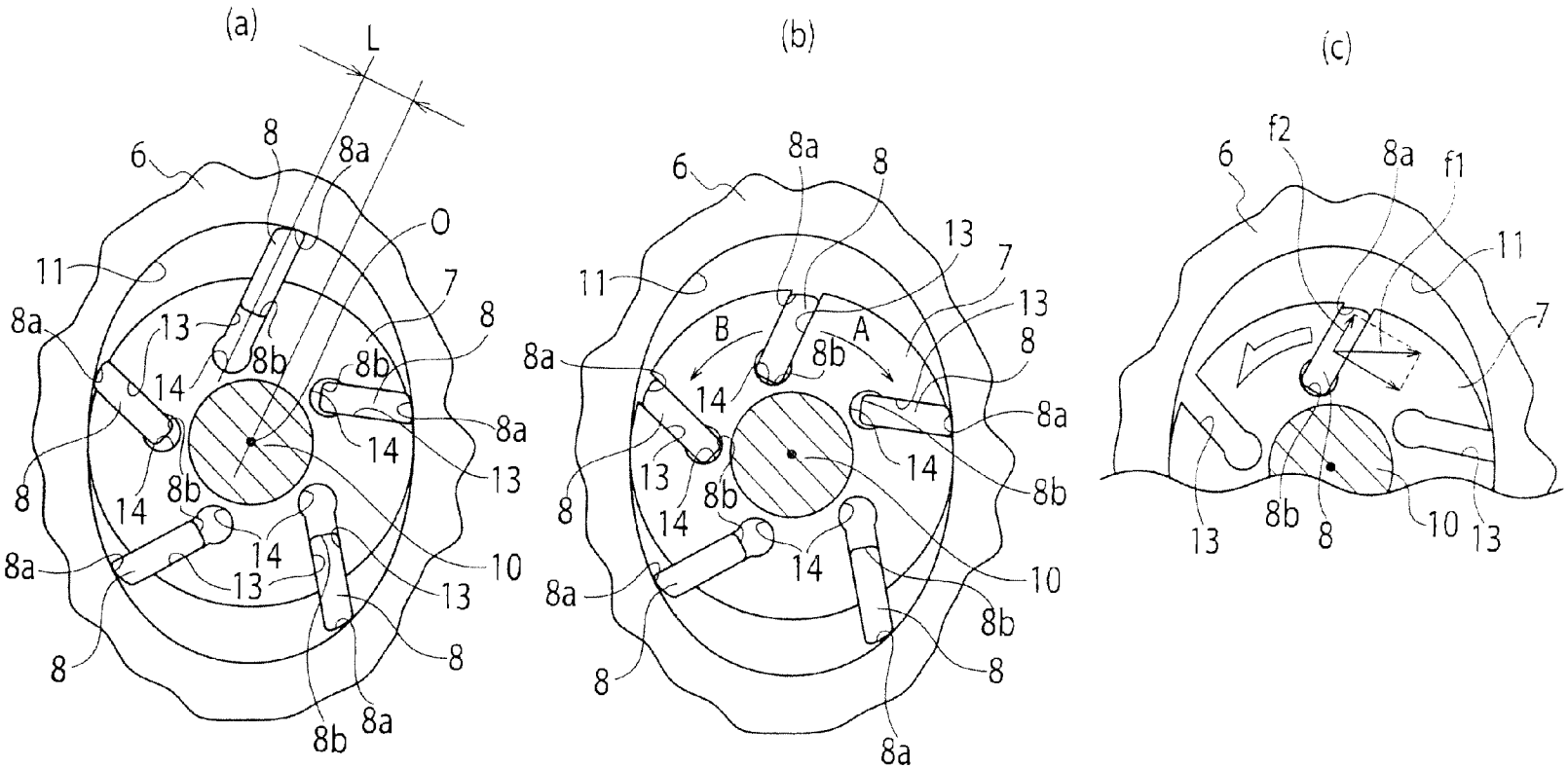
FIG. 3 (*a*) is an enlarged cross-sectional drawing showing a offset state of vane slots, (*b*) is an enlarged cross-sectional drawing showing a state where vanes are accommodated in the vane slots, and (*c*) is an enlarged cross-sectional drawing showing a reverse rotation of a rotor upon activating the compressor.

As shown in FIGS. 2 and 3, in the rotor 7, there are formed five vane slots 13 each of which is offset by a distance L from a radial line passing over a rotational center O of the rotor 7. The vanes 8 are slidably accommodated in the vane slots 13, respectively. The vane slots 13 are provided so as to be offset parallel on a reverse rotation side B opposite to a normal rotation side A of the rotor 7. Due to this offset, efficiency for compressing refrigerant can be improved. In addition, backpressure spaces 14 into which lubrication oil is introduced are formed between bottoms of the vane slots 13 and base edges 8*b* of the vanes 8 described below.

Each vane 8 is accommodated in each vane slot 13 and is protruded due to a rotation of the rotor, so that its end edge 8*a* slidably contacts with the inner wall surface 11 to compress refrigerant.

The pair of side blocks 9 (see FIG. 1) is arranged so as to sandwich the cylinder block 6, and engaged with the cylinder block 6 by bolts or the like.

The rotary shaft 10 is provided so as to penetrate the center of the rotor 7, and rotated by the electric motor 3 to transfer this rotational force to the rotor 7.

As shown by a block diagram in FIG. 4, in the compressor 1, the controller 15, the inverter 4, the electrical motor 3 and the compression mechanism 2 are connected with each other. The electrical motor 3 is controlled by the controller 15 via the inverter 4. Note that the compressor 1 is used in an air conditioning system, and the controller 15 is connected with an external A/C amplifier (air conditioning amplifier).

Figure 5:
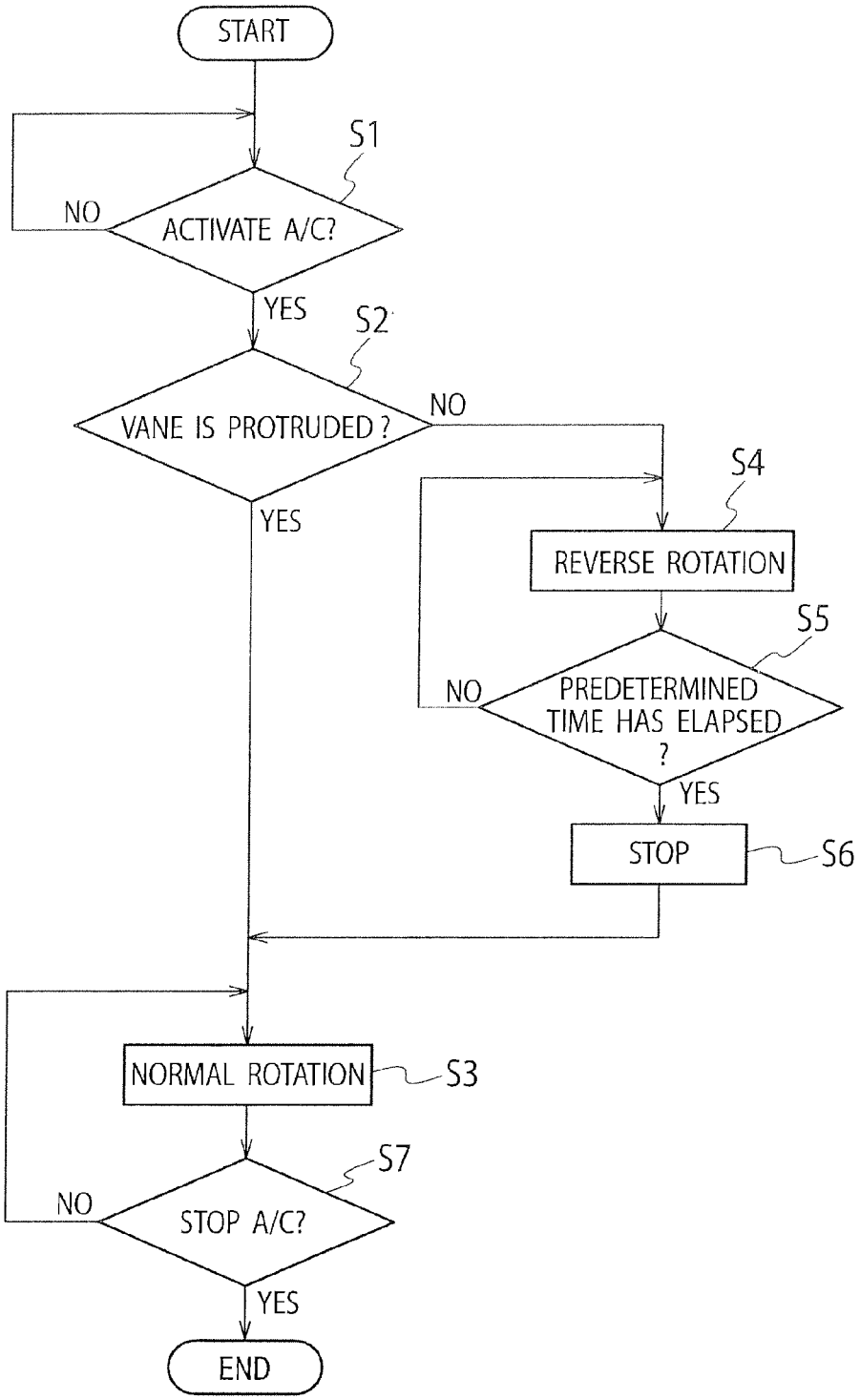
FIG. 5 is a control flow chart of the compressor.

Next, operations of the compressor 1 will be explained. As shown in FIG. 5, it is judged whether or not an air conditioner is activated (step S1), and then, when an activation command of the compressor 1 is generated (Yes in step S1), it is judged whether or not the vane(s) 8 accommodated in the vane slot(s) 13 protrudes form the vane slot(s) 13 (step S2). As explained above, especially, the vane 8 located at an upper position may be accommodated in the vane slot 13 due to its own weight (see FIGS. 3(*a*) to (*c*)). When the vane(s) 8 protrudes from the vane slot (s) 13 (Yes in step S2), the rotor 7 is normally rotated to compress refrigerant (step S3).

On the other hand, when the vane(s) 8 doesn't protrude from the vane slot(s) 13 (No in step S2), the rotor 7 is reversely rotated (step S4). Subsequently, it is judged whether or not a predetermined time for the reverse rotation of the rotor 7 has elapsed (step S5). When the predetermined time has not elapsed (No in step S5), the process flow is returned to step S4 to continue the reverse rotation. On the other hand, when the predetermined time has elapsed (Yes in step S5), the reverse rotation is stopped (step S6) and then the rotor 7 is normally rotated (step S3). Then, it is judged whether or not the air conditioner is stopped (step S7), the process flow ends when the air conditioner is stopped (Yes in step S7).

Namely, in the compressor 1, the rotor 7 is reversely rotated when the vane(s) 8 doesn't protrude from the vane slot(s) 13. A frictional force and a viscous force of lubrication oil occur between the vanes 8 and the side blocks 9 due to the reverse rotation of the rotor 7. As a result, a tangential force f1 to the rotation applies to the vane(s) 8 as shown in FIG. 3(*c*). A component force vector f2 of a force vector f1 applies to the vane(s) 8 as a force for protruding the vane (s) 8 from the vane slot(s) 13. Note that a centrifugal force due to the reverse rotation of the rotor 7 also applies so as to protrude the vane(s) 8. By the normal rotation of the rotor 7, such a component force vector f2 applying in a direction for protruding the vane(s) 8 doesn't apply.

In this manner, a force for protruding the vanes 8 from the vane slots 13 is applied by reversely rotating the rotor 7 for the predetermined time upon activating the compressor 1. By this force, a negative pressure is also generated in the backpressure spaces 14, so that lubrication oil and refrigerant are smoothly introduced into the backpressure spaces 14. Therefore, by the application of the friction force and the viscous force and the promotion of the backpressure generation (further, the centrifugal force), the vanes 8 can be surely protruded from the vane slots 13. As a result, since the vanes 8 can be surely protruded from the vane slots 13, chattering can be prevented. In addition, extra working processes for the vanes 8 or the vane slots 13 are not needed, so that the compressor 1 can be produced at low cost.

Furthermore, the controller 15 reversely rotates the rotor 7 at slower speed than its normal rotational speed (normal rotational speed at a steady operation), so that the vanes 8 can be protruded from the vane slots 13 more surely. Namely, by reversely rotating the rotor 7 at lower speed than its normal rotational speed, secured can be a sufficient time for generating the backpressure in the backpressure spaces 14 and introducing lubrication oil and refrigerant into the backpressure spaces 14 through the clearances.

Note that, if the reverse rotational speed is too high, before the vane 8 that is located at an upper position and accommodated in the vane slot 13 (see FIG. 3(*c*)) sufficiently protrudes from the vane slot 13, its end edge 8*a* contacts with the inner wall surface 11 near an ellipsoidal minor axis, so that the vane 8 cannot be smoothly protruded from the vane slot 13. Therefore, the vane(s) 8 can be protruded from the vane slot(s) 13 more surely by setting the reverse rotational speed to 10 rpm or less.

Second Embodiment

Next, a compressor 1 according to a second embodiment will be explained with reference to FIG. 6.

In the above-explained first embodiment, the controller 15 controls the electrical motor 3 as a drive source of the compression mechanism 2 to normally/reversely rotate the rotor 7. In the present embodiment, the controller 15 controls a gear mechanism 31 to normally/reversely rotate the rotor 7.

Figure 6:
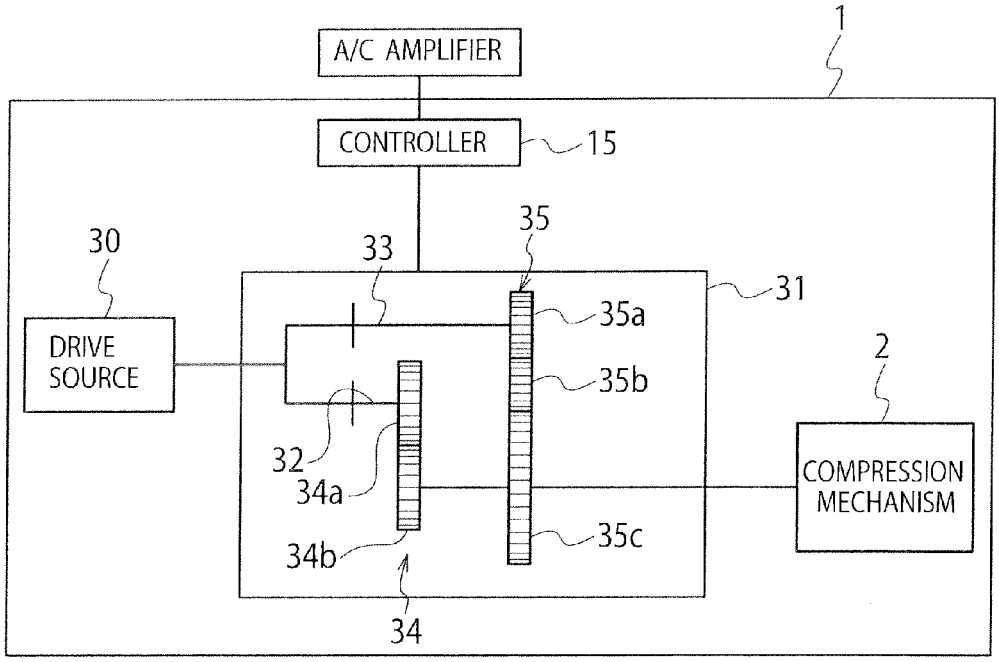
FIG. 6 is a block diagram of a compressor in a second embodiment.

As shown in FIG. 6, the gear mechanism 31 includes a normal rotation rotary shaft 32 and a reverse rotation rotary shaft 33 that are rotated by a rotational drive force form a drive source 30, a normal rotation gear set 34 provided on the normal rotation rotary shaft 32, and a reverse rotation gear set 35 provided on the reverse rotation rotary shaft 33.

The normal rotation gear set 34 has a normal rotation first gear 34*a* and a normal rotation second gear 34*b*, and coupled with the compression mechanism 2 via these gears 34*a* and 34*b*. The reverse rotation gear set 35 has a reverse rotation first gear 35*a*, a reverse rotation second gear 35*b* and a reverse rotation third gear 35*c*, and coupled with the compression mechanism 2 via these gears 35*a* to 35*c*.

Similarly to the above-explained first embodiment, the controller 15 judges, upon activating the air conditioner, whether or not the vane(s) 8 protrudes form the vane slot(s) 13. When the vane(s) 8 doesn't protrude form the vane slot(s) 13, the rotor 7 in the compression mechanism 2 is reversely rotated via the reverse rotation first to third gears 35*a* to 35*c* of the reverse rotation gear set 35. When normally rotating the rotor 7, the normal rotation first and second gears 34*a* and 34*b* are used. According to this, one with a simple mechanism can be used as the drive source 30 (if the drive source 30 is a motor, a motor that rotates only normally can be used). Advantages by the reverse rotation of the rotor 7 are the same as those in the above-explained first embodiment.

The invention claimed is:

1. A rotary vane compressor comprising:

a cylinder chamber having an ellipsoidal inner wall shape;

a rotor rotatably provided in the cylinder chamber;

a vane held in the rotor so as to contact with an inner wall surface of the cylinder chamber along with a rotation of the rotor;

a vane slot provided on the rotor and offset on a reverse rotational side of the rotor from a radial line passing over a rotational center of the rotor; and a controller configured to control a rotation of the rotor, and determine whether the vane protrudes from the vane slot, wherein when the controller determines that the vane does not protrude from the vane slot, the controller is configured to reversely rotate the rotor at a slower speed than a normal rotational speed for a predetermined time upon activating the compressor.

2. The compressor according to claim 1, wherein the controller is configured to reversely rotate the rotor at 10 rpm or less.

3. The compressor according to claim 1, further comprising:

an electrical motor configured as a drive source so as to rotate the rotor, wherein the controller is configured to reversely rotate the rotor by controlling a rotational direction of the electrical motor.

4. The compressor according to claim 1, further comprising:

a drive source configured to rotate the rotor; and a gear mechanism provided between the drive source and the rotor, the gear mechanism being configured to switch over a rotational direction of a rotational force transmitted from the drive source to the rotor, wherein the controller is configured to reversely rotate the rotor by controlling the gear mechanism.

5. The compressor according to claim 1, wherein a rotational axis of the rotor extends in a horizontal direction.

* * * * *